United States Patent [19]

Crowley

[11] 4,393,604

[45] Jul. 19, 1983

[54] OUTSOLE FOR ATHLETIC SHOE

[75] Inventor: Kevin J. Crowley, Newburyport, Mass.

[73] Assignee: Converse Inc., Wilmington, Mass.

[21] Appl. No.: 311,485

[22] Filed: Oct. 14, 1981

[51] Int. Cl.[3] ..... A43C 15/02

[52] U.S. Cl. ..... 36/67 R; 36/126; 36/128; 36/59 R; 36/67 A; 36/32 R

[58] Field of Search ..... 36/127, 128, 134, 32 R, 36/59 R, 59 A, 67 A, 67 C, 67 D, 67 R, 59 B, 59 C; D2/317, 320

[56] References Cited

U.S. PATENT DOCUMENTS

| | | | |
|---|---|---|---|
| 54,600 | 3/1920 | Cochrane | D2/317 |
| 2,564,802 | 8/1951 | Coleman et al. | 36/67 C |

FOREIGN PATENT DOCUMENTS

| | | | |
|---|---|---|---|
| 10307 | of 1904 | United Kingdom | 36/67 C |

*Primary Examiner*—Werner H. Schroeder
*Assistant Examiner*—Steven N. Meyers

[57] ABSTRACT

A molded outsole for an athletic shoe including molded, non-metallic studs or cleats includes a plurality of first substantially identical studs and a plurality of second substantially identical studs. The first studs have a shape characterized by three partially-overlapping frustoconical shapes, blended together to present an outline which does not retain dirt, in a triangular pattern, and produce a stud shorter than a second stud. The second studs have a shape characterized by a large frustoconical portion bounded by two partially-overlapping smaller frustoconical portions, of equal height, arranged to define a generally arcuate shape presenting a concave face and a convex face, the large frustoconical portion and the two small frustoconical portions being appropriately filleted to produce a smooth surface which does not retain dirt. These second studs may be oriented to support traction primarily in a predetermined direction, and to allow pivoting. The smaller studs may be oriented appropriately to provide lateral traction and to prevent an edge of the outsole from digging in. The disclosed outsole is useful without modification for the sports of baseball and football, and similar sports, and may be easily modified, by the removal of a stud, to be appropriate for the sport of soccer.

1 Claim, 6 Drawing Figures

OUTSOLE FOR ATHLETIC SHOE

This application is related to co-pending application Ser. No. (311,484) filed Oct. 14, 1981.

This application is related to the field of athletic shoes. In particular, this application is related to an outsole with non-metallic studs or cleats useful for such sports as baseball, football and soccer.

BACKGROUND OF THE INVENTION

Many different types of metallic cleats, studs or hob nails have been used to increase the traction or ground gripping ability of an athletic shoe, and have been made for attachment to a completed shoe, or attachment during manufacture of a shoe. Such metallic cleats, studs and hob nails have been found to produce good results, since, due to the strength of the material used, relatively thin sections with good penetrating ability are possible. However, if metallic studs, cleats or hob nails are not initially made sharp, they tend to become sharpened due to abrasion from repeated penetration of the earth. Even in a dull state, metallic cleats, studs or hob nails are likely to produce injury when the sole of the wearer's foot contacts another player during the playing of a game such as baseball, football or soccer. This situation is further aggravated when the studs, cleats or hob nails become sharpened by use.

SUMMARY OF THE INVENTION

It is a primary object of the invention to provide an outsole for an athletic shoe having a plurality of non-metallic cleats or studs which is suitable for use instead of an outsole fitted with metallic cleats or studs. It is a feature of the invention that the outsole includes two different configurations of cleats or studs, one configuration being larger than the other. It is a feature of the invention that these studs or cleats may be either integrally molded of the same plastic material used to form the remainder of the outsole or may be separately molded and affixed to the outsole.

It is a further object of the invention to provide a novel ground-gripping non-metallic stud or cleat having a shape characterized by a large frustoconical shape surrounded by two smaller frustoconical shapes of equal height, arranged in an arc, and including filet portions interconnecting the three frustoconical portions. It is a feature of the invention that this arcuate configuration may be disposed to maximize traction in a given direction.

It is a feature of the invention that a stud or cleat is produced which is usable as a replacement for a metallic cleat, on an outsole that may be used without modification for the sports of baseball and football, and may be modified by the removal of one such cleat for playing the sport of soccer.

DETAILED DESCRIPTION OF THE DRAWINGS

Figure 1:
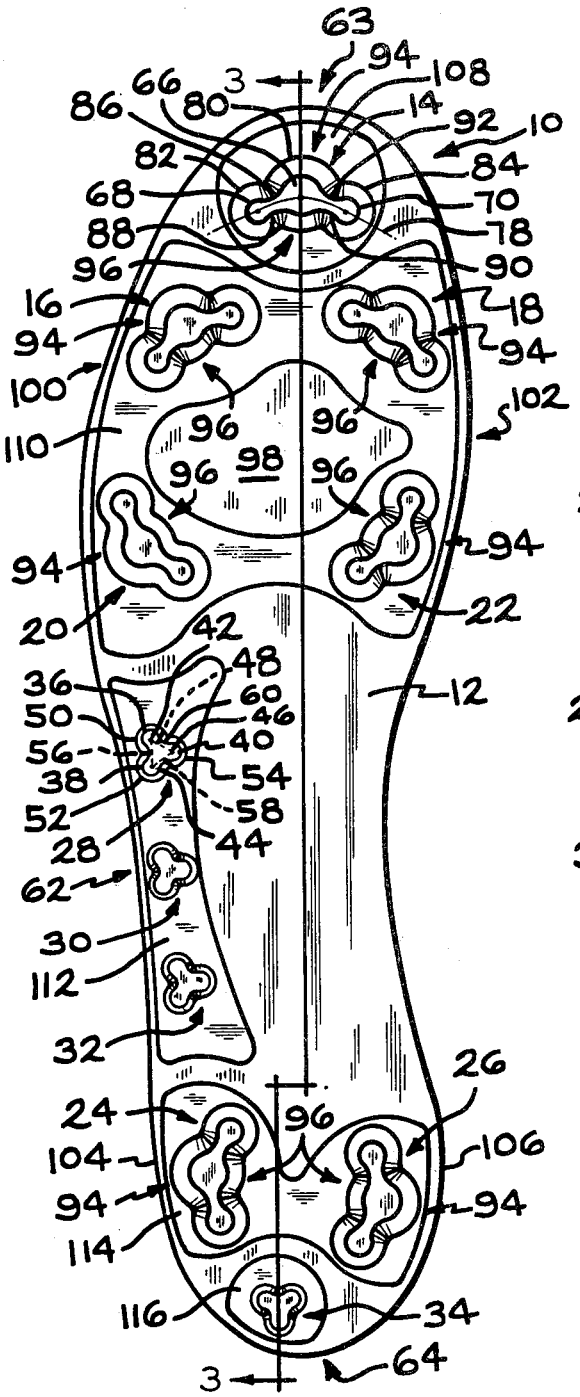
FIG. 1 is a bottom elevational plan view of an outsole according to the invention.
Figure 2:
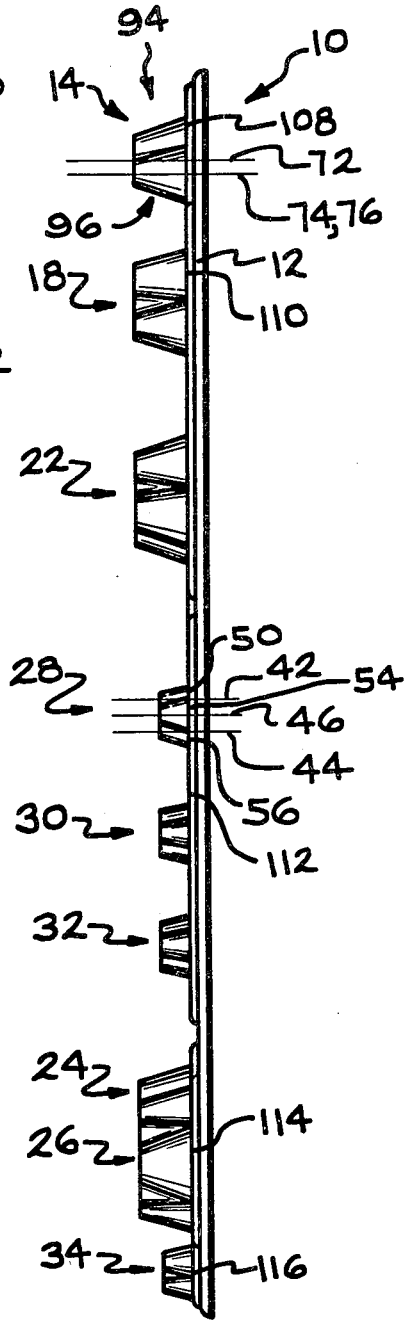
FIG. 2 is a side elevational view of the outsole of FIG. 1.
Figure 3:
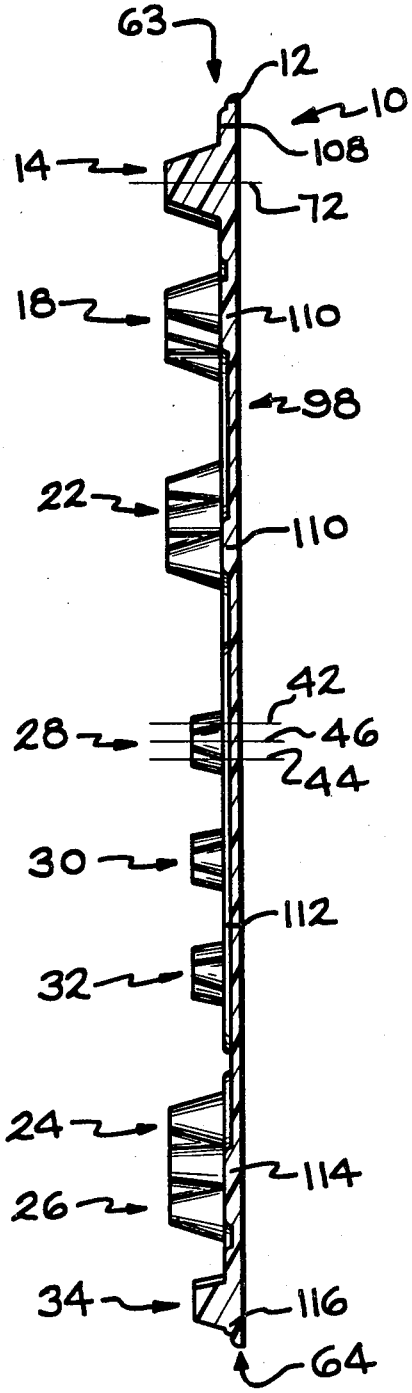
FIG. 3 is a sectional view taken along line 3—3 in FIG. 1.
Figure 4A:
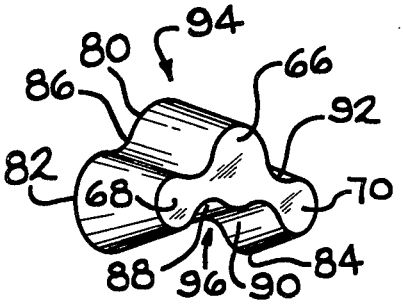
FIGS. 4*a*, 4*b*, and 4*c* are perspective views of a ground-gripping stud or cleat according to the invention.
Figure 4B:
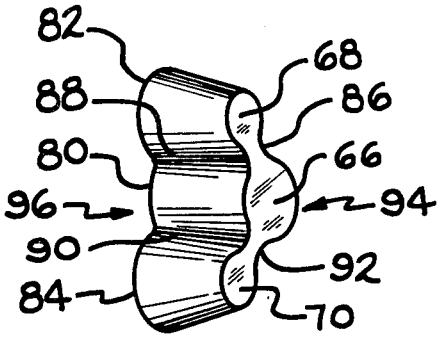
Figure 4C:
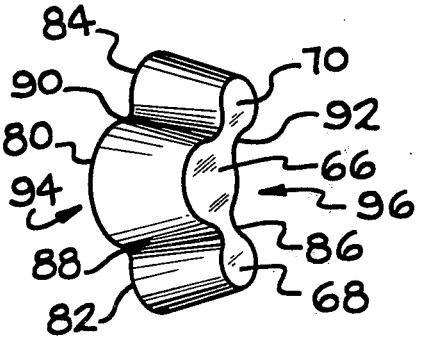

Referring to FIGS. 1, 2, 3, and 4*a*–4*c*, there is shown an outsole for an athletic shoe which is usable without change for football and baseball shoes, and may be modified to be suitable for playing the game of soccer by the removal of a stud located at the toe portion of the outsole. Specifically, an outsole 10 is shown as including an outsole member 12, provided with large studs or cleats which may be integrally molded of a plastic material such as polyurethane or polyvinylchloride, identified as studs 14, 16, 18, 20, 22, 24 and 26, and smaller studs or cleats, which also may be integrally molded or separately manufactured shown as studs 28, 30, 32 and 34. Studs 14, 16, 18, 20, 22, 24 and 26 protrude approximately the same distance from outsole member 12. In a preferred embodiment, studs 16, 18, 20 and 22 are slightly shorter than studs 14, 24 and 26, studs 14, 24 and 26 being approximately 0.5 inches (1.2 cm) in height, studs 16, 18, 20 and 22 being slightly shorter at 0.438 inches (1.10 cm). These figures include the heights of raised areas on which they may be mounted in accordance with this preferred embodiment.

As shown in the figures, the smaller studs, studs 28, 30, 32 and 34 are identical, and have a shape which may be characterized as being formed by three identical frustoconical bodies 36, 38 and 40, each having a central axis, identified as 42, 44 and 46, respectively, these axes being parallel to each other and defining the apexes of a triangle, preferably an equilateral triangle shown in broken lines as triangle 48. As will be apparent, the length of the sides of this hypothetical equilateral triangle is less than the radius of one of the three frustoconical bodies 36, 38, 40, so that the base portions 50, 52 and 54 respectively, overlap forming a solid body. Fillet portions 56, 58 and 60, respectively, interconnect frustoconical bodies 36, 38 and 40 to provide a smooth shape resistance to the collection of dirt in crevices. As will be apparent, these various portions and geometrical descriptions are not separate or separable parts of the actual embodiment of studs 28, 30, 32 and 34, but are merely provided to clearly explain the shape of these non-metallic molded studs.

Studs 28, 30 and 32 are positioned adjacent lateral instep edge 62, stud 28 being positioned between stud 30 and toe portion 63, stud 32 being positioned between stud 30 and heel portion 64. Stud 34 is positioned adjacent heel portion 44.

For example, when outsole 10 is used on a baseball shoe, studs 28, 30 and 32 are useful for base stealing, fielding and batting, serving to support a player's trailing foot during the swinging of a bat, control the depth of penetration of other studs during sliding and base stealing, and provide lateral traction for fielding and throwing. Any of these motions are equivalent in the sports of football and soccer, the stud placement giving equivalent results. Stud 34, adjacent heel area 64, serves to prevent the rear of the outsole from digging in, and limits the penetration of studs 24 and 26, to prevent a player from tripping while back pedaling.

As stated above, studs 14, 16, 18, 20, 22, 24 and 26 are substantially identical, having a characterizing shape of three frustoconical shapes of equal height, a large central member being bounded by two smaller members, appropriately filleted, in a fashion that yields a concave face and a convex face. These features are shown in detail in the drawings with respect to stud 14. The description of stud 14 applies equally to the remaining studs 16, 18, 20, 22, 24 and 26.

As shown, stud 14 has a shape characterized by a large frustoconical body 66, surrounded by two smaller but equal height frustoconical bodies 68 and 70. Bodies 66, 68 and 70 have major axes 72, 74 and 76, respectively, axes 72, 74 and 76 being parallel to each other and disposed so as to define points on an arc, such as arc 78, in any convenient plane. As shown, frustoconical bodies 66, 68 and 70 have base portions 80, 82 and 84, respectively which overlap, since the respective axes 72, 74, 76 have a spacing which is less than the combined radii of body 66 and 68 or 70. The shape of stud 14 is further characterized by fillet portions 86, 88, 90 and 92, interconnecting and blending the three frustoconical bodies 66, 68, 70. As a result, stud 14, as well as 16, 18, 20, 22, 24 and 26, defines a convex face 94 and a concave face 96. As shown, stud 14, which may advantageously be deleted to use outsole 10 for a soccer shoe, is disposed adjacent toe portion 63 with its convex face 94 towards toe portion 63, and its concave face 96 towards heel portion 64. Studs 16, 18, 20 and 22 are disposed around ball area 98, the area occupied by the ball area of wearer's foot, where the metatarsal bones join the first phalanges of the toes, and are arranged to facilitate pivoting of a wearer's foot, studs 16, 18, 20 and 22 being disposed with a respective convex face 94 adjacent an edge of outsole 10, and respective concave faces disposed towards a central portion of ball area 98. As shown, stud 16 is disposed adjacent lateral edge 100, between stud 20 and stud 14. Stud 18 is shown disposed adjacent medial edge 102, between stud 22 and stud 14 or toe area 63.

The remaining two large studs 24 and 26 are disposed adjacent heel portion 64, adjacent lateral edge 104 of heel portion 64, and medial edge 106 of heel portion 64, respectively. Studs 24 and 26 are oriented with their respective convex faces 94 adjacent respective edges 104 and 106, and respective concave faces facing.

As shown, stud 14 is disposed on a raised area 108, studs 16, 18, 20 and 22 are disposed on a raised area 110, studs 28, 30 and 32 are disposed on a raised area 112, studs 24 and 26 are disposed on a raised area 114, and stud 34 is disposed on a raised area 116. These areas may be eliminated, if desired, or may be made thicker to locally increase the stiffness of outsole 10, and may advantageously be stippled or roughened, to provide improved adhesion between outsole member 12 and separately-molded studs, if used. Also, separately-molded studs may advantageously be provided with two or three projections, not shown, fitting corresponding openings, not shown, in outsole member 12, to provide initial positioning and increased support for separately-molded studs.

The preferred embodiment of outsole 10 is integrally molded of polyurethane plastic, and a second embodiment is integrally molded from polyvinylchloride plastic, which, being slightly weaker, requires an increase in thickness of outsole member 12 over that illustrated. Separately-molded studs of such materials may be adhered to base member 12 using a urethane cement, which has been found to produce an adequate bonding where it is desired to use separately-molded studs, such as to provide studs of a different color than the color of base member 12.

Numerous modifications and variations of the invention including but not limited to modification in the positioning of studs shown, or in the exact shape of the studs shown, and may be easily made without departing from the spirit and scope of the invention.

I claim:

1. A cleat projection for an athletic shoe, having a shape characterized by three frustoconical members of equal height and unequal volume, two said members being smaller than a third said member, said third member being disposed between said smaller members, each of said three frustoconical members having a major axis, said major axes defining points on an arc, each said frustoconical member having a base portion, said base portions being overlapping portions, said shape including fillet portions interconnecting the sides of said frustoconical members.

* * * * *